United States Patent [19]

Georgiou

[11] Patent Number: 4,937,909

[45] Date of Patent: Jul. 3, 1990

[54] ROLLER STRUCTURE FOR USE IN A PAINT ROLLER, AND PAINT ROLLER INCORPORATING THE SAME

[76] Inventor: Rogiros P. Georgiou, 200 Gateway Boulevard, Apt. 1014, Toronto, Ontario, Canada, M3C 1B6

[21] Appl. No.: 11,908

[22] Filed: Feb. 6, 1987

[30] Foreign Application Priority Data

Feb. 10, 1986 [GR] Greece ..... 860383

[51] Int. Cl.[5] ..... B05C 1/08; B05C 17/02

[52] U.S. Cl. ..... 15/230.11; 15/230.19

[58] Field of Search ..... 15/230, 230.11, 230.14, 15/230.19, 247, 256.52; 29/110.5, 120, 121.5, 124, 132; 401/197

[56] References Cited

U.S. PATENT DOCUMENTS

| | | | |
|---|---|---|---|
| 233,211 | 12/1880 | Crooker . | |
| 2,584,724 | 2/1952 | Mattie . | |
| 2,645,845 | 7/1953 | Vengris . | |
| 2,751,618 | 6/1956 | Pruitt . | |
| 2,972,158 | 2/1961 | Voskresenski | 15/230.11 |
| 2,982,010 | 5/1961 | Johns | 15/230.11 |
| 3,094,770 | 6/1963 | Williams | 29/116 R |
| 3,702,739 | 11/1972 | Rentfrow | 401/197 |
| 3,751,748 | 8/1973 | Roe | 15/230.11 |
| 3,986,226 | 10/1976 | Roe | 15/230.11 |
| 4,237,575 | 12/1980 | Mlachnik | 15/230.11 |
| 4,237,592 | 12/1980 | Kuge et al. . | |

FOREIGN PATENT DOCUMENTS

| | | | |
|---|---|---|---|
| 113343 | 3/1969 | Denmark | 15/230.11 |
| 1261037 | 2/1968 | Fed. Rep. of Germany | 15/230.11 |
| 1393923 | 2/1965 | France | 15/230.11 |
| 2351714 | 12/1977 | France | 401/197 |
| 850631 | 4/1985 | Greece . | |
| 117343 | 7/1969 | Norway | 15/230.11 |

*Primary Examiner*—Harvey C. Hornsby
*Assistant Examiner*—Scott J. Haugland
*Attorney, Agent, or Firm*—Ridout & Maybee

[57] ABSTRACT

In order to overcome the disadvantage in paint rollers of the type in which the end portions of the fabric sleeve are reflexly foldably disposed within the end portions of the tubular member and are securely clamped therein that paint may operatively seep along the clamped reflexly foldably disposed end portions of the fabric sleeve and into the interior of the tubular member, there is provided a paint roller of the above-described type in which the clamping of the reflexly foldably disposed end portions of the fabric sleeve within the end portions of the tubular member is by means of tubular end collars which are disposed within these end portions of the fabric sleeve and the inner end portions of which are in substantially liquid-tight direct locking engagement with inwardly projecting annular ribs presented by the end portions of the tubular member.

17 Claims, 1 Drawing Sheet

Figure 1:
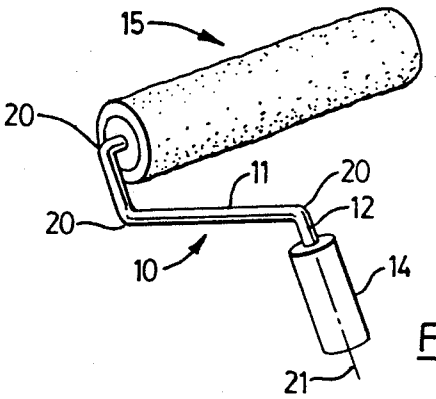

ROLLER STRUCTURE FOR USE IN A PAINT ROLLER, AND PAINT ROLLER INCORPORATING THE SAME

This invention is concerned with a roller structure for use in a paint roller and with a paint roller which incorporates such a roller structure, the roller structure being of the type which comprises a tubular member on an outer surface of which a fabric sleeve is adapted to be mounted with end portions of the fabric sleeve being reflexly foldably disposed within the end portions of the tubular member and being clamped therein, thereby to secure the fabric sleeve to the tubular member.

Formerly the conventional practice was for the ends of the fabric sleeve to terminate at the ends of the tubular member with the fabric sleeve being bonded by means of a glue or other adhesive to the outer surface of the tubular member. However, a disadvantage of this form of roller structure is that through use the paint or paint thinner frequently dissolves or at least softens the glue or other adhesive by means of which the fabric sleeve is bonded to the outer surface of the tubular member, with the result that the fabric sleeve is no longer securely mounted on the outer surface of the tubular member and the roller structure requires replacement. While such replacement of the roller structure is a less serious economic consideration where the fabric sleeve is of inexpensive material it is of course more significant economically where the fabric sleeve is of high quality, expensive material such as, for example, natural lambswool, and it is with the view to overcoming this disadvantage that there was devised the above-described type of roller structure in which the fabric sleeve is mounted on the outer surface of the tubular member but instead of being bonded thereto by glue or other adhesive has end portions thereof reflexly foldably disposed within and clamped to the tubular member in order to secure the fabric sleeve to the tubular member. An example of a roller structure of this type for use in a paint roller is disclosed in, for example, U.S. Pat. No. 2,645,845 issued on July 21, 1953 to M. P. Vengris.

It is, however, a disadvantage of roller structures of the above-described type as hitherto known and used that, although the reflexly foldably disposed end portions of the fabric sleeve are clamped within the end portions of the tubular member, paint may nevertheless operatively seep by, for example, capillary action through the clamped end portions of the fabric sleeve into the interior of the tubular member. This constitutes, of course, a wastage of paint, but perhaps more importantly it results in the weight of the paint roller when in use being significantly increased, with the result that it can become extremely tiring for the user to use the paint roller particularly for an extended period of time, and furthermore subsequent cleaning of the paint from the interior of the tubular member can be extremely difficult particularly if the paint has hardened. It is a primary object of the present invention to provide a roller structure for use in a paint roller, and a paint roller incorporating such a roller structure, in which this disadvantage is substantially overcome or mitigated.

In accordance with the present invention there is provided a roller structure for use in a paint roller, the roller structure comprising a tubular member and two open-bore tubular shell-like end collars, the tubular member having an inner surface and an outer surface and having two end portions, each presenting on the inner surface of the tubular member an inwardly projecting annular rib spaced from the respective end of the tubular member. Each tubular end collar has an inner end portion and an outer end portion, and is adapted to be disposed within a respective end portion of the tubular member, with a predetermined narrow annular gap between the tubular end collar and the inner surface of the tubular member at the respective end portion thereof, but with the inner end portion of the tubular end collar in substantially liquid-tight engagement with the inner surface of the tubular member at a position spaced from the respective end of the tubular member.

In accordance with a further aspect of the present invention there is provided a roller structure for use in a paint roller, the roller structure comprising a tubular member having an inner surface and an outer surface and having two end portions, and two open-bore tubular shell-like end collars each of which has an inner end portion and an outer end portion and is adapted to be disposed within a respective end portion of the tubular member with a predetermined narrow annular gap between the tubular end collar and the inner surface of the tubular member at the respective end portion thereof, but with the inner end portion of the end collar in substantially liquid-tight engagement with the inner surface of the tubular member at a position spaced from the respective end of the tubular member. The tubular member comprises two interconnectible tubular member parts, and a ring member which is adapted to be disposed within the tubular member at the junction between the tubular member parts. The ring member has two opposed end portions which are engageable in a substantially liquid-tight locking manner with the respective adjacent end portions of the tubular member parts to provide said interconnection between the tubular member parts.

Figure 2:
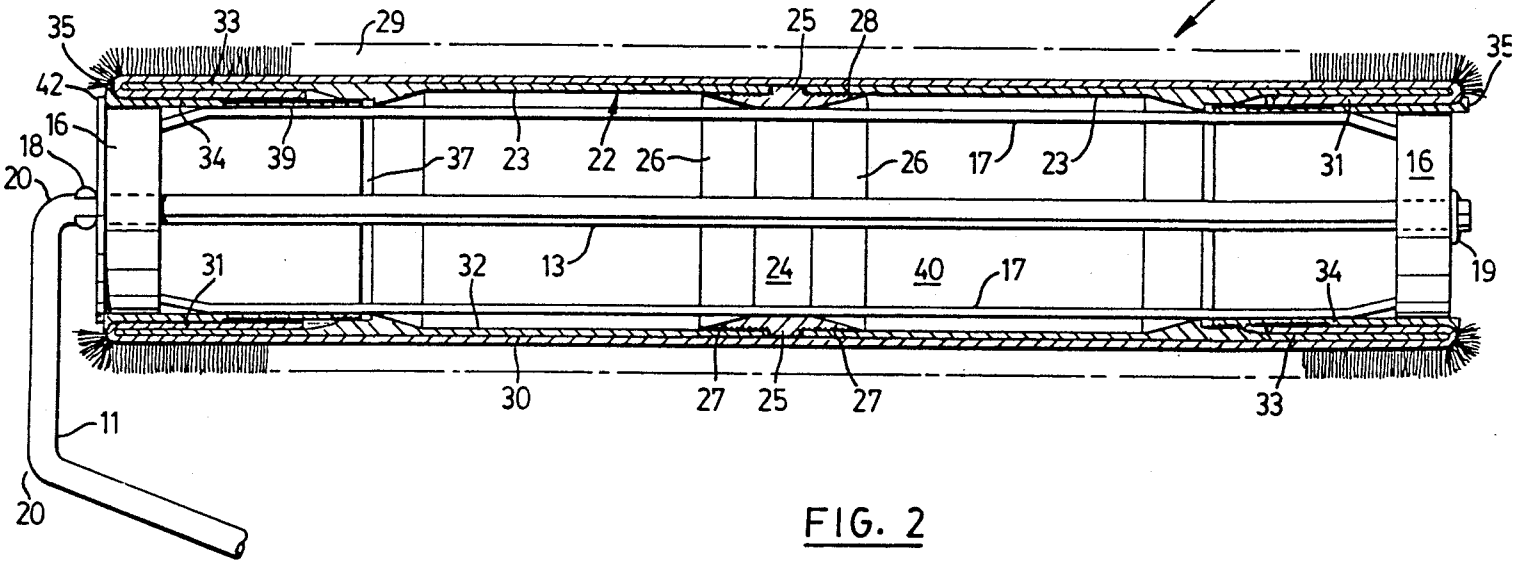
Figure 3:
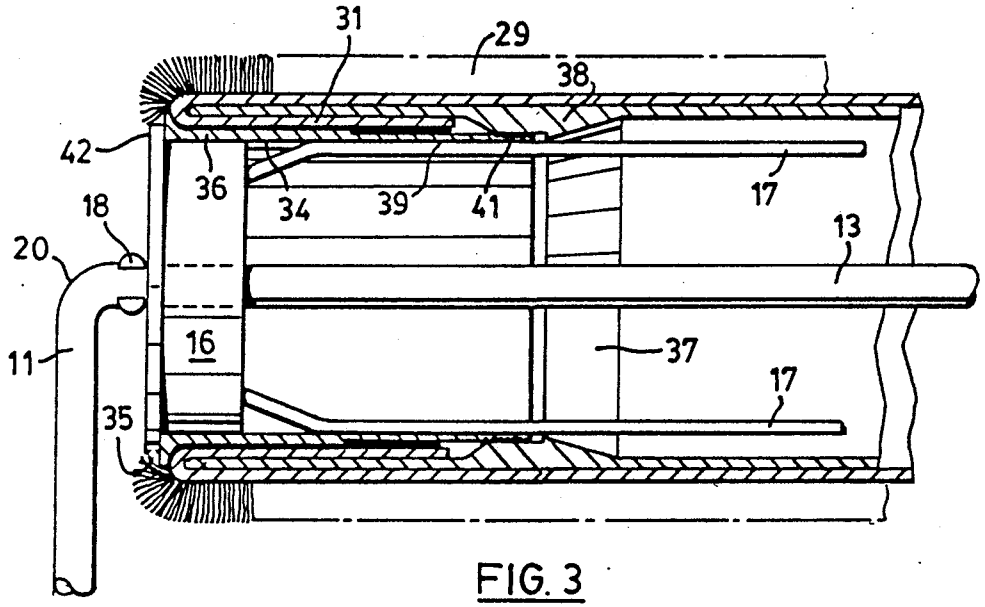

In order that the present invention may be more clearly understood and more readily carried into effect the same will now, by way of example, be more fully described with reference to the accompanying drawings in which FIG. 1 is a view of a paint roller according to a preferred embodiment of the invention;

FIG. 2 is a view on a considerably enlarged scale of a portion of the paint roller shown in FIG. 1, portions of the paint roller being shown in section; and FIG. 3 is a further enlarged view of one end portion of FIG. 2.

Referring to the drawings, 10 denotes generally a paint roller which comprises a rod 11 having a first end portion 12 and a second end portion 13, a handle 14 mounted on the first end portion 12 of the rod 11, and a roller structure which is denoted generally by the reference numeral 15 and which is hereinafter more fully described. Two end plugs 16 interconnected by a plurality of equi-angularly spaced wires 17 are freely rotatably mounted on the second end portion 13 of the rod 11, the wires 17 which are outwardly bowed being stiff but resiliently deformable, with the roller structure 15 being adapted to be mounted on the end plugs 16 and the outwardly bowed wires 17 disposed therebetween so that the roller structure 15 is thereby freely rotatably mounted on the second end portion 13 of the rod 11. The rod 11 is provided with, for example, pinched portions 18 and a lock washer 19 which is frictionally secured to the rod 11 in order to maintain the end plugs 16 and the wires 17 disposed therebetween, at the desired location on the second end portion 13 of the rod 11. The rod 11, the handle 14, and the end plugs 16 with the wires 17 disposed therebetween may be of conventional form, the rod 11 being provided with, for example, bends 20 such that the longitudinal axis 21 of the handle 14 is substantially at right angles to the second end portion 13 of the rod 11.

The roller structure 15 comprises a tubular member 22 which may be of molded polyethylene plastics material and which, in order to facilitate manufacture of the tubular member 22, is preferably constituted by two tubular member parts 23 which are interconnectible in adjacent, end-to-end relationship by a ring member 24 disposed within the tubular member 22 at the junction between the tubular member parts 23, the ring member 24 which may also be of molded polyethylene plastics material having an outwardly projecting annular rib 25 disposed between the adjacent ends of the tubular member parts 23, and the opposed end portions 26 of the ring member 24 being engageable in a substantially liquid-tight locking manner with the respective adjacent end portions 27 of the tubular member parts 23. In the preferred embodiment of the invention illustrated in the accompanying drawings this substantially liquid-tight locking engagement between the end portions 26 of the ring member 24 and the adjacent end portions 27 of the tubular member parts 23 is constituted by the inner faces of adjacent end portions 27 of the tubular member parts 23 being so tapered as to be divergent in the direction towards the respective ends of the tubular member parts 23, with the end portions 26 of the ring member 24 having outer tapered faces which are convergent in the direction towards the respective ends of ring member 24, the taper of these outer faces of the end portions 26 of the ring member 24 corresponding to that of the adjacent end portions 27 of the tubular member parts 23. Thus, in mounting the tubular member parts 23 on the ring member 24 to form the tubular member 22 there is a secure wedging action between the end portions 26 of the ring member 24 and the end portions 27 of the tubular member parts 23. In order to improve the liquid-tight locking engagement between the ring member 24 and the tubular member parts 23 the outer tapered faces of the end portions 26 of the ring member 24 may be provided with annular serrations 28, although alternatively or in addition such annular serrations could be provided on the inner tapered faces of the end portions 27 of the tubular member parts 23.

A fabric sleeve 29 which may be of natural lambswool on a lambskin backing is adapted to be mounted on the outer surface 30 of the tubular member 22 with end portions 31 of the fabric sleeve 29 being reflexly foldably disposed on the inner surface 32 of the end portions 33 of the tubular member 22.

In addition to the tubular member 22 the roller structure 15 comprises two open-bore tubular shell-like end collars 34 which may be of molded nylon construction and which are adapted to be disposed within the respective end portions 33 of the tubular member 22 with the reflexly foldably disposed end portions 31 of the fabric sleeve 29 securely clamped between the tubular end collars 34 and the respective end portions 33 of the tubular member 22, the outer end of each tubular end collar 34 having an outwardly directed annular flange 35 which likewise securely clamps the fabric sleeve 29 against the respective end of the tubular member 22. As is more clearly shown in FIG. 3 the outer end portion 36 of each tubular end collar 30 may be of slightly increased outer dimensions relative to the remainder of the tubular end collar 34, with the above-mentioned clamping of the reflexly foldably disposed end portions 31 of the fabric sleeve 29 between the tubular end collars 34 and the end portions 33 of the tubular member 22 being primarily at the location of these outer end portions 36 of increased outer dimensions of the tubular end collars 34.

Thus, with the tubular end collars 34 operatively disposed within the respective end portions 33 of the tubular member 22 there is a predetermined narrow annular gap between each of the tubular end collars 34 and the inner surface of the respective end portion 33 of the tubular member 22, with the reflexly foldably disposed end portions 31 of the fabric sleeve 29 disposed within this gap securely clamped between the tubular end collar 34 and the inner surface of the respective end portion 33 of the tubular member 22.

The inner face 32 of each end portion 33 of the tubular member 22 has an inwardly projecting annular rib 37 having an annular land 38 with which the inner end portion 39 of the respective end collar 34 is directly engageable in a substantially liquid-tight manner, thereby substantially to prevent any paint which operatively may seep by, for example, capillary action along the reflexly foldably disposed end portions 31 of the fabric sleeve 29 clamped between the tubular end collars 34 and the end portions 33 of the tubular member 22 from entering into the interior cavity 40 of the tubular member 22. Preferably the annular land 38 of each annular rib 37 is so tapered as to be divergent in the direction towards the respective end of the tubular member 22, and the inner end portion 39 of each tubular end collar 34 has an outer tapered face which is convergent in the direction towards the inner end of the tubular end collar 34 and the taper of which corresponds to that on the respective annular land 38. Thus, as in the case of the engagement between the end portions 26 of the ring membert 24 and the adjacent end portions 27 of the tubular member parts 22 there is a secure wedging action between the inner end portions 39 of the tubular end collars 34 and the respective annular lands 38 of the annular ribs 37 to provide locking engagement therebetween. This substantially liquid-tight engagement between the inner end portions 39 of the tubular end collars 34 and the respective annular lands 38 of the annular ribs 37 results, of course, from the interference fit therebetween i.e. each part of the inner end portions 39 is of slightly larger diameter than the part of the respective annular lands 38 with which it is in wedging contact. To improve the substantially liquid-tight locking engagement between the inner end portions 39 of the tubular end collars 34 and the annular lands 38 of the annular ribs 37 the outer tapered face of the inner end portions 39 of each tubular end collar 34 may be provided with annular serrations 41, although alternatively or in addition such annular serrations could be provided on the tapered annular lands 38 of the annular ribs 37.

The mounting of the roller structure 15 on the end plugs 16 and the wires 17 disposed therebetween is achieved by sliding the roller structure 15 over the end plugs 16 and wires 17, the tubular end collars 34 being securely frictionally mounted on the wires 17. In this condition the second end portion 13 of the rod 11 extends, of course, through the tubular member 22. The outer end of the end plug 16 which is farthest from the end of the rod 11 may present an outwardly projecting annular end flange 42 with which the flange 35 of the appropriate tubular end collar 34 abuts when the roller structure 15 is fully mounted on the end plugs 16 and the wires 17.

The substantially liquid-tight direct locking engagement between the inner end portions 39 of the tubular end collars 34 and the annular lands 38 of the annular ribs 37 substantially prevents the entry therebetween of paint into the interior cavity 40 of the tubular member 22, substantially overcoming the above-described disadvantages which result from such entry of paint into the interior cavity 40 of the tubular member 22.

It will, of course, be appreciated that the roller structure 15 of the present invention may be used in the conventional manner with a standard type of spinner device which is used to spin the roller structure of a paint roller for cleaning the fabric sleeve of the roller structure.

I claim:

1. A roller structure for use in a paint roller, the roller structure comprising a tubular member having an inner surface and an outer surface and having two end portions, each presenting on the inner surface of the tubular member an inwardly projecting annular rib spaced from the respective end of the tubular member, and two open-bore tubular shell-like end collars each of which has an inner end portion and an outer end portion and is adapted to be disposed within a respective end portion of the tubular member with a predetermined narrow annular gap between the tubular end collar and the inner surface of the tubular member at the respective end portion thereof, but with the inner end portion of the end collar in substantially liquid-tight engagement with the respective annular rib.

2. A roller structure for use in a paint roller, the roller structure comprising a tubular member having an inner surface and an outer surface and having two end portions, each presenting on the inner surface of the tubular member an inwardly projecting annular rib spaced from the respective end of the tubular member, a fabric sleeve which has two end portions and which is mounted on the outer surface of the tubular member with the end portions of the fabric sleeve being reflexly foldably disposed on the inner surface of the respective end portions of the tubular member, and two open-bore tubular shell-like end collars each of which has an inner end portion and an outer end portion and is disposed within a respective end portion of the fabric sleeve, with each end portion of the fabric sleeve being substantially securely clamped between the respective tubular end collar and the inner surface of the respective end portion of the tubular member, but with the inner end portions of the tubular end collars being in substantially liquid-tight, direct engagement with the respective annular ribs.

3. A paint roller comprising a rod having a first end portion and a second end portion, a handle which has a longitudinal axis and which is mounted on the first end portion of the rod with the longitudinal axis of the handle substantially at right angles to the second end portion of the rod, two spaced end plugs freely rotatably mounted on the second end portion of the rod, a tubular member having an inner surface and an outer surface and having two end portions, each presenting on the inner surface of the tubular member an inwardly projecting annular rib spaced from the respective end of the tubular member, a fabric sleeve which has two end portions and which is mounted on the outer surface of the tubular member with the end portions of the fabric sleeve being reflexly foldably disposed on the inner surface of the respective end portions of the tubular member, and two open-bore tubular shell-like end collars each of which has an inner end portion and an outer end portion and is disposed within a respective end portion of the fabric sleeve, with each end portion of the fabric sleeve being substantially securely clamped between the respective tubular end collar and the inner surface of the respective end portion of the tubular member, but with the inner end portions of the tubular end collars being in substantially liquid-tight direct engagement with the respective annular ribs, the tubular end collars being securely mounted on the respective end plugs with the second end portion of the rod extending through the tubular member.

4. A roller structure according to claim 1, wherein the outer end portion of each tubular end collar is of increased outer dimensions relative to the outer dimensions of the remainder of the tubular end collar.

5. A roller structure according to claim 1, wherein each tubular end collar has an outer end having an outwardly projecting annular end flange.

6. A roller structure according to claim 1, wherein each annular rib presents an annular land with which the inner end portion of the respective tubular end collar is engageable to provide said substantially liquid-tight engagement between the inner end portion of the tubular end collar and the respective annular rib, the annular land presented by each annular rib being so tapered as to be divergent in the direction towards the respective end of the tubular member.

7. A roller structure according to claim 1, wherein the inner end portion of each tubular end collar has an outer tapered face which is convergent in the direction towards the inner end of the tubular end collar.

8. A roller structure according to claim 7, wherein the outer tapered face of the inner end portion of each tubular end collar has annular serrations.

9. A roller structure according to claim 1, wherein each annular rib presents an annular land with which the inner end portion of the respective tubular end collar is engageable to provide said substantially liquid-tight engagement between the inner end portion of the tubular end collar and the respective annular rib, the annular land presented by each annular rib being so tapered as to be divergent in the direction towards the respective end of the tubular member, and the inner end portion of each tubular end collar having an outer tapered face which is convergent in the direction towards the inner end of the tubular end collar.

10. A roller structure for use in a paint roller, the roller structure comprising a tubular member having an inner surface and an outer surface and having two end portions, and two open-bore tubular shell-like end collars each of which has an inner end portion and an outer end portion and is adapted to be disposed within a respective end portion of the tubular member with a predetermined narrow annular gap between the tubular end collar and the inner surface of the tubular member at the respective end portion thereof, but with the inner end portion of the end collar in substantially liquid-tight engagement with the inner surface of the tubular member at a position spaced from the respective end of the tubular member, the tubular member comprising two interconnectible tubular member parts, and a ring member which is adapted to be disposed within the tubular member at the junction between the tubular member parts, with the ring member having two opposed end portions which are engageable in a substantially liquid-tight locking manner with the respective adjacent end portions of the tubular member parts to provide said interconnection between the tubular member parts, inner faces of the adjacent end portions of the tubular member parts being so tapered as to be divergent in the direction towards the respective ends of the tubular member parts.

11. A roller structure for use in a paint roller, the roller structure comprising a tubular member having an inner surface and an outer surface and having two end portions, and two open-bore tubular shell-like end collars each of which has an inner end portion and an outer end portion and is adapted to be disposed within a respective end portion of the tubular member with a predetermined narrow annular gap between the tubular end collar and the inner surface of the tubular member at the respective end portion thereof, but with the inner end portion of the end collar in substantially liquid-tight engagement with the inner surface of the tubular member at a position spaced from the respective end of the tubular member, the tubular member comprising two interconnectible tubular member parts, and a ring member which is adapted to be disposed within the tubular member at the junction between the tubular member parts, with the ring member having two opposed end portions which are engageable in a substantially liquid-tight locking manner with the respective adjacent end portions of the tubular member parts to provide said interconnection between the tubular member parts, the end portions of the ring member having outer tapered faces which are convergent in the direction towards the respective ends of the ring member.

12. A roller structure for use in a paint roller, the roller structure comprising a tubular member having an inner surface and an outer surface and having two end portions, and two open-bore tubular shell-like end collars each of which has an inner end portion and an outer end portion and is adapted to be disposed within a respective end portion of the tubular member with a predetermined narrow annular gap between the tubular end collar and the inner surface of the tubular member at the respective end portion thereof, but with the inner end portion of the end collar in substantially liquid-tight engagement with the inner surface of the tubular member at a position spaced from the respective end of the tubular member, the tubular member comprising two interconnectible tubular member parts, and a ring member which is adapted to be disposed within the tubular member at the junction between the tubular member parts to provide said interconnection between the tubular member parts, with the ring member having two opposed end portions which are engageable in a substantially liquid-tight locking manner with the respective adjacent end portions of the tubular member parts to provide said interconnection between the tubular member parts, inner faces of the adjacent end portions of the tubular member parts being so tapered as to be divergent in the direction towards the respective ends of the tubular member parts, and the end portions of the ring member having outer tapered faces which are convergent in the direction towards the respective ends of the ring member.

13. A roller structure according to claim 11, wherein the outer tapered face of each end portion of the ring member has annular serrations.

14. A roller structure according to claim 10, wherein the ring member has an outwardly projecting annular rib adapted to be disposed between the tubular member parts.

15. A roller structure according to claim 2, wherein the fabric sleeve comprises natural lambswool.

16. A roller structure according to claim 1, wherein the tubular member is of polyethylene plastics material, and the tubular end collars are of nylon.

17. A roller according to claim 10, wherein the tubular member and the ring member are of polyethylene plastics material, and the tubular end collars are of nylon.

* * * * *